US009238358B1

(12) United States Patent
Kamoda et al.

(10) Patent No.: US 9,238,358 B1
(45) Date of Patent: Jan. 19, 2016

(54) MULTICOLOR OFFSET PRINTING PRESS

(71) Applicant: Komori Corporation, Sumida-ku, Tokyo (JP)

(72) Inventors: Hiroyoshi Kamoda, Ibaraki (JP); Takashi Suto, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/841,453

(22) Filed: Aug. 31, 2015

(30) Foreign Application Priority Data

Sep. 2, 2014 (JP) ..... 2014-177715

(51) Int. Cl.
*B41F 5/16* (2006.01)
*B41F 7/02* (2006.01)

(52) U.S. Cl.
CPC ..... *B41F 7/025* (2013.01)

(58) Field of Classification Search
CPC ..... B41F 11/02
USPC ..... 101/177
See application file for complete search history.

(56) References Cited

U.S. PATENT DOCUMENTS 4,697,515 A * 10/1987 Germann ..... B41F 11/02 101/176
5,036,763 A * 8/1991 Germann ..... B41F 11/02 101/177
6,101,939 A * 8/2000 Giori ..... B41F 11/02 101/177
2001/0054364 A1* 12/2001 Kusaka ..... B41F 33/0036 101/483
2008/0271620 A1* 11/2008 Hoier ..... B41F 11/02 101/216
2013/0319269 A1* 12/2013 Turke ..... B41F 9/021 101/174

FOREIGN PATENT DOCUMENTS

JP H02-022057 A 1/1990
JP 2524289 Y 11/1996

* cited by examiner

*Primary Examiner* — Anthony Nguyen
(74) *Attorney, Agent, or Firm* — Blakely Sokoloff Taylor & Zafman LLP

(57) ABSTRACT

A multicolor offset printing press includes a first blanket cylinder, at least four plate cylinders, a collecting plate cylinder, a collecting blanket cylinder, at least two partial plate cylinders, and a plurality of ink devices. The first blanket cylinder performs printing on a transported target printing product. The four plate cylinders are in contact with the first blanket cylinder. The collecting plate cylinder is in contact with the first blanket cylinder on the downstream side in the rotational direction of the first blanket cylinder with respect to a last plate cylinder positioned on the most downstream side in the rotational direction of the first blanket cylinder among the four plate cylinders, and on the upstream side in the rotational direction of the first blanket cylinder with respect to a printing portion at which the first blanket cylinder performs printing on the target printing product. The collecting blanket cylinder is in contact with the collecting plate cylinder and transfers ink to the collecting plate cylinder. The two partial plate cylinders are in contact with the collecting blanket cylinder. The plurality of ink devices supply inks to the four plate cylinders and the two partial plate cylinders, respectively.

4 Claims, 1 Drawing Sheet

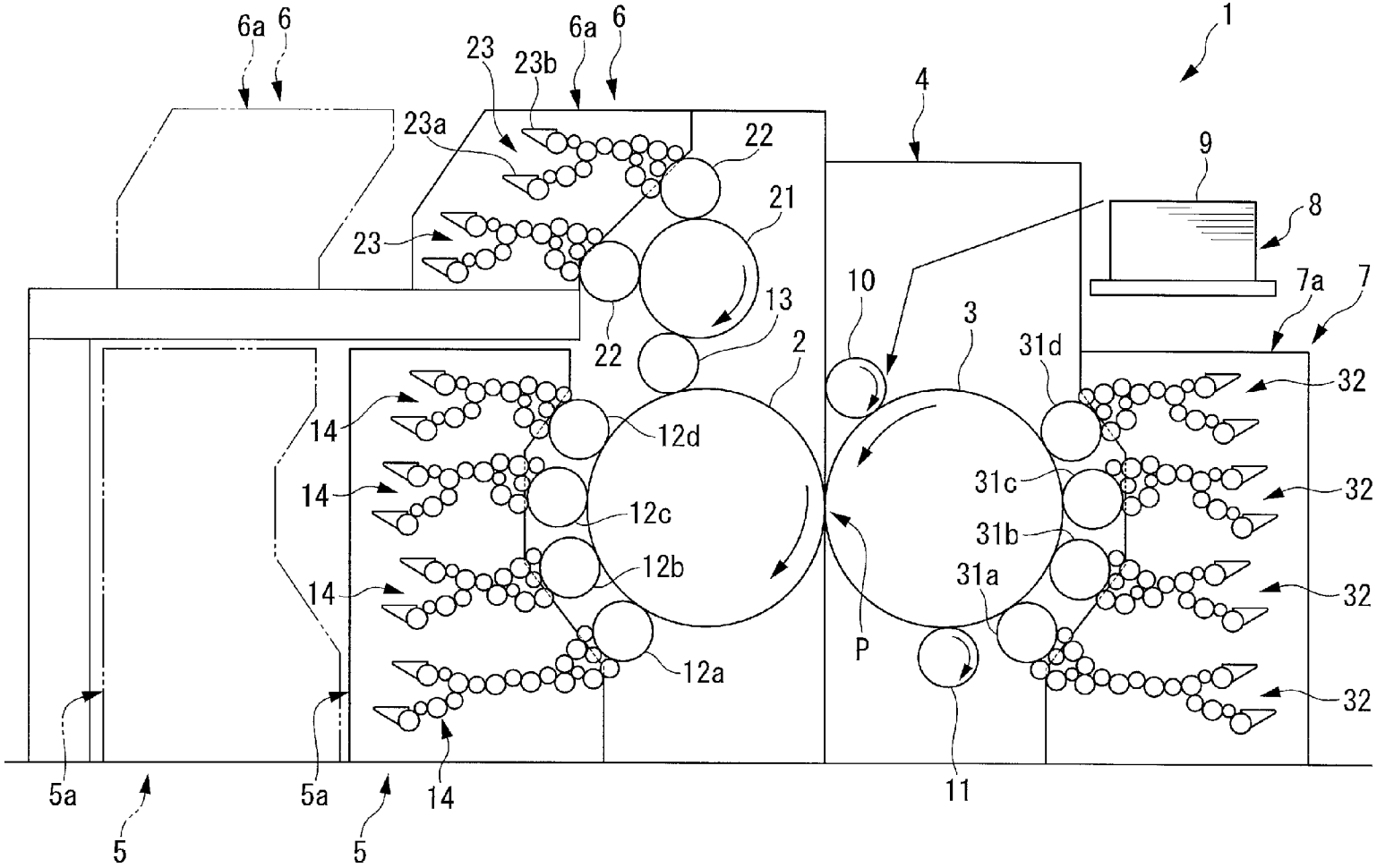
1
9
8
7
7a
32
32
32
32
31d
31c
31b
31a
3
4
11
10
P
2
13
21
22
22
12d
12c
12b
12a
6
6a
23b
23
23a
23
14
14
14
14
5
5a
6
6a
5
5a

MULTICOLOR OFFSET PRINTING PRESS

BACKGROUND OF THE INVENTION

The present invention relates to a multicolor offset printing press that performs multicolor offset printing at once on a target printing product.

To print a bank note, securities, and the like, multicolor offset printing presses disclosed in Japanese Utility Model Registration No. 2524289 (literature 1) and Japanese Patent Laid-Open No. 2-22057 (literature 2) are used.

The multicolor offset printing press disclosed in literature 1 performs Simultan printing on the two surfaces of a sheet. This multicolor offset printing press includes a pair of blanket cylinders that perform printing on a sheet, four plate cylinders in contact with one blanket cylinder, and four plate cylinders in contact with the other blanket cylinder. The multicolor offset printing press performs four-color Simultan printing on the obverse surface of a sheet and also performs four-color Simultan printing on the reverse surface of the sheet.

The multicolor offset printing press disclosed in literature 2 includes a pair of blanket cylinders that perform printing on a sheet, four plate cylinders in contact with one blanket cylinder, two plate cylinders in contact with the other blanket cylinder, and a Sammeldruck collecting plate cylinder in contact with the other blanket cylinder. A Sammeldruck collecting blanket cylinder is in contact with the Sammeldruck collecting plate cylinder. Three Sammeldruck pattern plate cylinders are in contact with the Sammeldruck collecting blanket cylinder. This multicolor offset printing press is a double-sided multicolor offset Sammeldruck printing press.

Forgery prevention is always requested of a printing press that prints a bank note and securities. In order to prevent forgery, it is effective to increase the number of colors of printing products. Thus, the above-mentioned multicolor offset printing press needs to further increase the number of colors from the viewpoint of forgery prevention.

SUMMARY OF THE INVENTION

The present invention has as its object to provide a multicolor offset printing press capable of performing more advanced forgery prevention printing.

To achieve the above object, according to the present invention, there is provided a multicolor offset printing press comprising a first blanket cylinder that performs printing on a transported target printing product, at least four plate cylinders in contact with the first blanket cylinder, a collecting plate cylinder that is in contact with the first blanket cylinder on a downstream side in a rotational direction of the first blanket cylinder with respect to a last plate cylinder positioned on a most downstream side in the rotational direction of the first blanket cylinder among the at least four plate cylinders, and on an upstream side in the rotational direction of the first blanket cylinder with respect to a printing portion at which the first blanket cylinder performs printing on the target printing product, a collecting blanket cylinder that is in contact with the collecting plate cylinder and transfers ink to the collecting plate cylinder, at least two partial plate cylinders in contact with the collecting blanket cylinder, and a plurality of ink devices that supply inks to the at least four plate cylinders and the at least two partial plate cylinders, respectively.

BRIEF DESCRIPTION OF THE DRAWING

FIG. 1 is a side view showing a multicolor offset printing press according to an embodiment of the present invention.

DESCRIPTION OF THE PREFERRED EMBODIMENTS

A multicolor offset printing press according to an embodiment of the present invention will now be described in detail with reference to FIG. 1. A multicolor offset printing press 1 shown in FIG. 1 includes a printing unit 4 including a pair of blanket cylinders constituted by a first blanket cylinder 2 and a second blanket cylinder 3, a first ink unit 5 and second ink unit 6 arranged on the side of the first blanket cylinder 2, and a third ink unit 7 arranged on the side of the second blanket cylinder 3. Blankets are mounted around the first blanket cylinder 2 and the second blanket cylinder 3.

The multicolor offset printing press 1 performs Simultan printing on the two surfaces of a sheet 9 serving as a target printing product fed from a sheet supply device 8 drawn at the upper right portion of FIG. 1. The multicolor offset printing press 1 can perform part of printing on the obverse surface of the sheet 9 by Sammeldruck printing, details of which will be described later. Simultan printing is a printing method in which a plurality of plate cylinders are arranged around one blanket cylinder, inks are collected from these plate cylinders to the blanket cylinder, and then printing is performed. Sammeldruck printing is a printing method in which inks of different colors are partially applied to one plate to perform multicolor printing at once.

The sheet 9 is transported from the sheet supply device 8 to the second blanket cylinder 3 via a first transfer cylinder 10. Although not shown, gripper devices are provided for the first transfer cylinder 10 and the second blanket cylinder 3, respectively. By gripping change of the sheet 9 by the gripper devices of the first transfer cylinder 10 and second blanket cylinder 3, the sheet 9 can be transported between the cylinders 10 and 3 in the multicolor offset printing press 1.

The second blanket cylinder 3 holds the sheet 9 and rotates to transport the sheet 9 to a printing portion P at which the second blanket cylinder 3 and the first blanket cylinder 2 are in contact with each other. That is, the second blanket cylinder 3 functions as a transport cylinder. At the printing portion P, the second blanket cylinder 3 and the first blanket cylinder 2 nip the sheet 9 in cooperation, and multicolor printing is performed simultaneously on the two surfaces of the sheet 9. More specifically, the first blanket cylinder 2 performs printing on the obverse surface of the sheet 9, and the second blanket cylinder 3 performs printing on the reverse surface of the sheet 9. The printing portion P is a portion at which the first blanket cylinder 2 performs printing on the sheet 9. In this embodiment, the printing portion P is a portion at which the first blanket cylinder 2 and the second blanket cylinder 3 perform printing on the two surfaces of the sheet 9.

The printed sheet 9 is fed from a second transfer cylinder 11 in contact with the lower portion of the second blanket cylinder 3 to a discharge device or another printing press (neither is shown). The other printing press is, e.g., an intaglio printing press or an offset printing press.

Four plate cylinders (first plate cylinders) 12*a*, 12*b*, 12*c*, and 12*d*, and one collecting plate cylinder 13 are in contact with the outer surface of the first blanket cylinder 2 in the rotational direction of the first blanket cylinder 2 on the downstream side in the rotational direction of the first blanket cylinder 2 with respect to the printing portion P. Dry offset printing plates (not shown) are mounted on the four plate cylinders 12*a* to 12*d*.

Four first ink devices 14 are provided in correspondence with the respective four plate cylinders 12*a* to 12*d*. The first ink devices 14 are connected to the corresponding plate cylinders 12*a* to 12*d* to supply inks of different colors to the plate cylinders 12*a* to 12*d*. The inks supplied to the plate cylinders 12*a* to 12*d* are transferred to the first blanket cylinder 2.

The first ink devices 14 are included in the first ink unit 5 and supported by a first support frame 5*a*. The first ink unit 5 is movable between a use position indicated by a solid line in FIG. 1, and a withdrawal position indicated by a chain double-dashed line in FIG. 1. When the first ink unit 5 is at the use position, the four first ink devices 14 are connected to the four plate cylinders 12*a* to 12*d*. When the first ink unit 5 moves to the withdrawal position, the four first ink devices 14 are separated from the four plate cylinders 12*a* to 12*d*. In this state, the maintenance of the four plate cylinders 12*a* to 12*d* and the first blanket cylinder 2 is performed.

The collecting plate cylinder 13 is disposed on the downstream side in the rotational direction of the first blanket cylinder 2 with respect to the last plate cylinder 12*d* positioned on the most downstream side in the rotational direction of the first blanket cylinder 2, and on the upstream side in the rotational direction of the first blanket cylinder 2 with respect to the printing portion P. The collecting plate cylinder 13 is arranged at a position higher than the four plate cylinders 12*a* to 12*d*. A collecting blanket cylinder 21 is in contact with the outer surface of the collecting plate cylinder 13. The collecting blanket cylinder 21 transfers ink to the collecting plate cylinder 13. Two partial plate cylinders 22 are in contact with the outer surface of the collecting blanket cylinder 21. Relief printing plates (not shown) are mounted on the partial plate cylinders 22 and the above-described collecting plate cylinder 13, respectively. On the relief printing plates mounted on the partial plate cylinders 22, different portions of a pattern to be printed by the second ink unit 6 are formed, respectively, and relief portions for transferring ink to different portions of the collecting blanket cylinder 21 are formed. An entire pattern to be printed by the second ink unit 6 is formed on the relief printing plate mounted on the collecting plate cylinder 13. Ink patterns transferred from the relief printing plates of the partial plate cylinders 22 to the collecting blanket cylinder 21 are collected and transferred to the collecting plate cylinder 13. The partial plate cylinders 22, the above-described collecting blanket cylinder 21, the collecting plate cylinder 13, and the first blanket cylinder 2 can perform Sammeldruck printing on the sheet 9.

Two second ink devices 23 are provided in correspondence with the respective two partial plate cylinders 22. The second ink devices 23 are so-called double-duct ink devices including two ink fountains 23*a* and 23*b* in which inks of different colors are stored. The second ink devices 23 can perform rainbow printing (in this embodiment, even one rainbow printing is regarded as one-color printing). The two second ink devices 23 are connected to the corresponding partial plate cylinders 22 and supply inks of different colors to the partial plate cylinders 22, respectively. The two partial plate cylinders 22 transfer the inks supplied from the two second ink devices 23 to the collecting blanket cylinder 21. The collecting blanket cylinder 21 collects the inks from the two partial plate cylinders 22, and transfers them to the collecting plate cylinder 13.

The second ink devices 23 are included in the second ink unit 6 and supported by a second support frame 6*a*. The second ink unit 6 is movable between a use position indicated by a solid line in FIG. 1, and a withdrawal position indicated by a chain double-dashed line in FIG. 1. When the second ink unit 6 is at the use position, the two second ink devices 23 are connected to the two partial plate cylinders 22. When the second ink unit 6 moves to the withdrawal position, the two second ink devices 23 are separated from the two partial plate cylinders 22. In this state, the maintenance of the two partial plate cylinders 22 and the collecting blanket cylinder 21 is performed.

Four plate cylinders (second plate cylinders) 31*a*, 31*b*, 31*c*, and 31*d* are in contact with the outer surface of the second blanket cylinder 3 in the rotational direction of the second blanket cylinder 3 on the downstream side in the rotational direction of the second blanket cylinder 3 with respect to the printing portion P. Dry offset printing plates (not shown) are mounted on the plate cylinders 31*a* to 31*d*. Four third ink devices 32 are provided in correspondence with the respective four plate cylinders 31*a* to 31*d*. The third ink devices 32 are connected to the corresponding plate cylinders 31*a* to 31*d* to supply inks of different colors to the plate cylinders 31*a* to 31*d*, respectively. The inks supplied to the plate cylinders 31*a* to 31*d* are transferred to the second blanket cylinder 3.

The third ink devices 32 are included in the third ink unit 7 and supported by a third support frame 7*a*. Similar to the first ink unit 5 described above, the third ink unit 7 is movable between a use position indicated by a solid line in FIG. 1, and a withdrawal position (not shown) at which the third ink unit 7 is separated from the plate cylinders 31*a* to 31*d*. When the third ink unit 7 is at the use position, the four third ink devices 32 are connected to the four plate cylinders 31*a* to 31*d*. When the third ink unit 7 moves to the withdrawal position, the four third ink devices 32 are separated from the four plate cylinders 31*a* to 31*d*. In this state, the maintenance of the four plate cylinders 31*a* to 31*d* and the second blanket cylinder 3 is performed.

In the multicolor offset printing press 1 having the above-described arrangement, inks are transferred from the four plate cylinders 12*a* to 12*d* to the first blanket cylinder 2, and inks of two colors are transferred from the collecting plate cylinder 13. By replacing the collecting plate cylinder 13 with one having a different plate configuration, either of Sammeldruck printing of printing one drawing line by using two colors, and printing of printing one image by using two colors can be performed.

Hence, four-color printing is performed on the obverse surface of the sheet 9 by using the four plate cylinders 12*a* to 12*d*, and two-color printing is performed by using the two partial plate cylinders 22. That is, six-color Simultan printing is performed on the obverse surface of the sheet 9. In addition, four-color Simultan printing is performed on the reverse surface of the sheet 9 by transferring inks from the four plate cylinders 31*a* to 31*d* to the second blanket cylinder 3. For example, when printing securities such as a bank note, printing of a background pattern (ground tint) of four colors by the four plate cylinders 12*a* to 12*d*, and a money amount, country name, and the like by the two partial plate cylinders 22 is performed on the obverse surface of the sheet 9, and printing of a background pattern (ground tint) of four colors by the four plate cylinders 31*a* to 31*d* is performed on the reverse surface of the sheet 9. This embodiment can therefore provide a multicolor offset printing press capable of increasing the number of colors of multicolor printing in Simultan printing, and performing more advanced forgery prevention printing. In this embodiment, the color of ink transferred from each of the eight plate cylinders 12*a* to 12*d* and 31*a* to 31*d* and the two partial plate cylinders 22 is counted as one color.

The collecting plate cylinder 13 is disposed on the downstream side in the rotational direction of the first blanket cylinder 2 with respect to the plate cylinder 12*d* positioned on the most downstream side in the rotational direction of the first blanket cylinder 2, and on the upstream side in the rotational direction of the first blanket cylinder 2 with respect to the printing portion P. With this arrangement, images from the two partial plate cylinders 22 are transferred to images of four colors from the four plate cylinders 12*a* to 12*d* on the first blanket cylinder 2. On the obverse surface of the sheet 9, a money amount, country name, and the like by the two partial plate cylinders 22 can be overprinted in a background pattern (ground tint) of four colors by the four plate cylinders 12*a* to 12*d*.

In this embodiment, the partial plate cylinders 22, the collecting blanket cylinder 21, the collecting plate cylinder 13, and the blanket cylinder 2 perform Sammeldruck printing on the sheet 9. Overprinting by Sammeldruck printing can be performed, and printing can be executed so that, for example, a money amount by the partial plate cylinder 22 has a Sammeldruck pattern. This further enhances the forgery prevention effect.

In this embodiment, the transport cylinder is constituted by the second blanket cylinder 3 in contact with the plurality of plate cylinders 31*a* to 31*d*. Since Simultan printing is performed on the two surfaces of the sheet 9, the forgery prevention effect is further enhanced.

As described above, the multicolor offset printing press 1 according to this embodiment performs six-color Simultan printing on the obverse surface of the sheet 9, and performs four-color Simultan printing on the reverse surface of the sheet 9. Since Simultan printing can be performed on the obverse and reverse surfaces of the sheet 9 in a maximum of 10 colors in total, a higher forgery prevention effect can be obtained.

In this embodiment, the four plate cylinders 12*a* to 12*d* are in contact with the first blanket cylinder 2, and the four plate cylinders 31*a* to 31*d* are in contact with the second blanket cylinder 3. The two partial plate cylinders 22 are in contact with the collecting blanket cylinder 21. However, the present invention is not limited to this. More specifically, each of the number of plate cylinders in contact with the first blanket cylinder 2 and the number of plate cylinders in contact with the second blanket cylinder 3 can be five or more, and the number of partial plate cylinders 22 can be three or more. By increasing the number of colors in this manner, the forgery prevention effect is further enhanced.

The multicolor offset printing press 1 according to this embodiment is arranged at the upstream end of a printing line on which a plurality of printing presses perform printing on the sheet 9. However, the present invention is not limited to this. The multicolor offset printing press 1 can be arranged at the downstream end of the printing line or between a plurality of printing presses. More specifically, it is also possible to first perform Simultan printing on the sheet 9 by the multicolor offset printing press 1, then convey the sheet 9 to another printing press, and perform another printing. It is also possible to perform printing on the sheet 9 by another printing press, then convey the sheet 9 to the multicolor offset printing press 1, and perform Simultan printing. Further, the sheet 9 can be conveyed to another printing press and undergo another printing.

This embodiment has exemplified and described the multicolor offset printing press 1 that performs Simultan printing on the two surfaces of the sheet 9. However, the present invention is not limited to this. More specifically, the present invention is also applicable to a multicolor offset printing press that performs printing on only one surface of a sheet. In addition, the target printing product is not limited to a sheet and may be a web.

What is claimed is:

1. A multicolor offset printing press comprising:

a first blanket cylinder that performs printing on a transported target printing product;

at least four plate cylinders in contact with the first blanket cylinder;

a collecting plate cylinder that is in contact with the first blanket cylinder on a downstream side in a rotational direction of the first blanket cylinder with respect to a last plate cylinder positioned on a most downstream side in the rotational direction of the first blanket cylinder among the at least four plate cylinders, and on an upstream side in the rotational direction of the first blanket cylinder with respect to a printing portion at which the first blanket cylinder performs printing on the target printing product;

a collecting blanket cylinder that is in contact with the collecting plate cylinder and transfers ink to the collecting plate cylinder;

at least two partial plate cylinders in contact with the collecting blanket cylinder; and a plurality of ink devices that supply inks to the at least four plate cylinders and the at least two partial plate cylinders, respectively.

2. The multicolor offset printing press according to claim 1, wherein the at least two partial plate cylinders, the collecting blanket cylinder, the collecting plate cylinder, and the first blanket cylinder are configured to perform Sammeldruck printing on the target printing product.

3. The multicolor offset printing press according to claim 1, wherein the target printing product is a sheet, and the multicolor offset printing press further comprises:

a second blanket cylinder that holds and transports the sheet; and a plurality of plate cylinders in contact with the second blanket cylinder.

4. The multicolor offset printing press according to claim 3, wherein the number of the plurality of plate cylinders is at least four.

* * * * *